United States Patent [19]

Ishii

[11] 4,408,951

[45] Oct. 11, 1983

[54] FLUID DRIVEN ENGINE

[76] Inventor: Tasuku Ishii, 32 Miyanowaki Aza Kayama Oaza, Tokiwamachi, Tamura-gun, Fukushima-ken, Japan

[21] Appl. No.: 329,203

[22] Filed: Dec. 9, 1981

[30] Foreign Application Priority Data

Dec. 10, 1980 [JP] Japan ..... 55-175135

[51] Int. Cl.[3] ..... F01D 17/06

[52] U.S. Cl. ..... 415/36; 415/82; 415/30

[58] Field of Search ..... 415/30, 36, 60, 63, 415/65, 66, 67, 68, 69, 80, 81, 202; 60/39.16 S, 39.16 C, 39.34, 39.35

[56] References Cited

U.S. PATENT DOCUMENTS

| | | | |
|---|---|---|---|
| 760,035 | 5/1904 | Stumpf | 415/69 |
| 906,133 | 12/1908 | Hedlund | 415/60 X |
| 925,127 | 6/1909 | McDonald | 415/63 |
| 3,172,263 | 3/1965 | Quick et al. | 415/36 X |
| 3,287,904 | 11/1966 | Warren et al. | 60/39.34 |
| 3,365,171 | 1/1968 | Erwin | 415/69 |
| 3,879,949 | 4/1975 | Hays et al. | 415/202 X |
| 4,280,791 | 7/1981 | Gawne | 415/202 X |
| 4,298,311 | 11/1981 | Ritzi | 415/80 |
| 4,302,683 | 11/1981 | Burton | 60/39.35 X |

FOREIGN PATENT DOCUMENTS

| | | | |
|---|---|---|---|
| 150532 | 4/1937 | Austria | 60/39.34 |
| 422557 | 1/1971 | France | 60/39.34 |
| 573090 | 2/1958 | Italy | 60/39.35 |
| 2017828 | 10/1979 | United Kingdom | 415/202 |

*Primary Examiner*—Philip R. Coe
*Assistant Examiner*—Frankie L. Stinson
*Attorney, Agent, or Firm*—Wenderoth, Lind & Ponack

[57] ABSTRACT

A speed governor for engines which comprises a rotary hollow shaft receiving exhaust fluid at one end, a conduit and nozzle assembly connected at the other end of the rotary hollow shaft and including a needle valve, a turbine housing in which at least one turbine disposed on after another in the flow path of said exhaust fluid, a turbine drive shaft associated with said turbine, respectively, a movable annular member disposed about said rotary hollow shaft for movement in the axial direction of the rotary hollow shaft and a spring-loaded link connected to said needle valve at one end and engaging said annular member at the other end.

7 Claims, 3 Drawing Figures

FLUID DRIVEN ENGINE

BACKGROUND OF THE INVENTION

This invention relates to a novel and improved fluid driven engine to be employed in connection with engines such as turbine engines, jet engines and engines for ships, for example, to utilize the exhaust fluid from the engines as the drive fluid.

A variety of engines for using the exhaust fluid from hydraulic engines, steam engines and the like have been so far proposed and practically employed and in most of the prior art engines of this type, the nozzle or nozzles and the needle valve or valves adapted to regulate the opening of nozzle or nozzles are generally disposed on a stationary part of the engine and the needle valve or valves regulate the flow rate of exhaust fluid which passes through the nozzle or nozzles into the engine. However, it has been found that the prior art engines are generally inefficient.

SUMMARY OF THE INVENTION

Therefore, the present invention has as its objects to eliminate the disadvantages inherent in the prior art engines of the above type and to improve the performance of the engines by disposing the nozzle and the needle valve regulating the opening of the nozzle on a rotary part of the engine, rotating the preceding one of the turbines arranged one after another in the flow path of the fluid with fluid jetted from the nozzle, simultaneously rotating the housing of the turbines in the opposite direction to the rotation direction of the preceding turbine by the reaction generated at the jetting of fluid through the nozzle into the turbine housing and utilizing the reactive rotation of the housing as part of the output of the engine to drive a driven machine (a generator, for example) with improved efficiency.

And according to the present invention, exhaust fluid under vapor or hydraulic pressure from a vapor or hydraulic turbine is jetted at a metered flow rate through the nozzle into the rotary turbine housing to rotate the housing which in turn generates centrifugal force and the needle valve disposed in the nozzle is operated by the utilization of the centrifugal force to regulate the opening of the nozzle to thereby maintain a driven rotary machine (a generator) at a constant rotational speed.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

PREFERRED EMBODIMENT OF THE INVENTION

The present invention will be now described referring to the accompanying drawing in which one preferred embodiment of the engine of the invention is shown.

Figure 1:
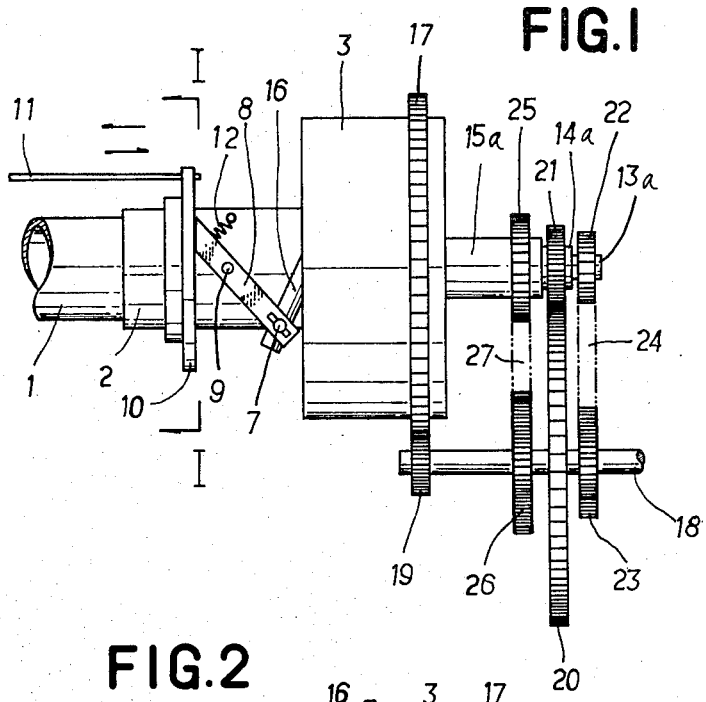
FIG. 1 is a side elevational view of one embodiment of the engine constructed in accordance with the present invention with a portion thereof broken away.
Figure 2:
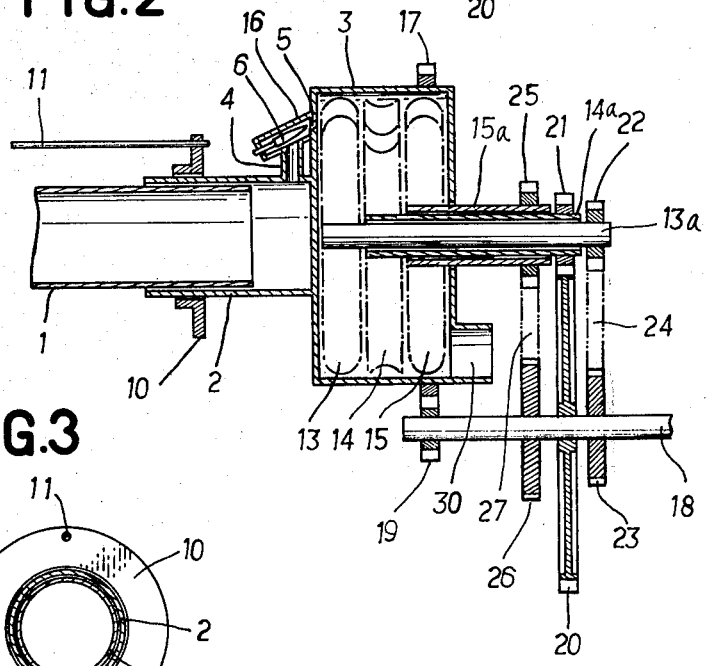
FIG. 2 is a longitudinal sectional view of said speed governor as shown in FIG. 1.
Figure 3:
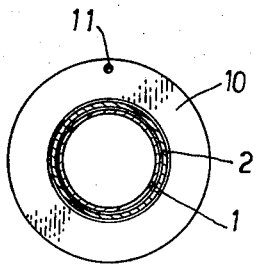
FIG. 3 is a cross-sectional view taken substantially along the line I-I FIG. 1.

In the drawing, reference numeral 1 denotes a stationary exhaust fluid feed conduit adapted to feed exhaust fluid from a supply source such as a jet engine, steam engine or the like (not shown) to the engine of the invention and extending into a rotary hollow shaft 2 journalled on the conduit 1 to feed the exhaust fluid through the shaft into the turbine housing of the engine which will be described in detail hereinafter. The end of the rotary hollow shaft 2 remote from the exhaust fluid feed conduit 1 has the turbine housing 3 coaxially secured thereto for rotation together with the shaft 2. The housing 3 is not in direct fluid communication with the rotary hollow shaft 2. A short fluid conduit 4 extends at one end from the rotary hollow shaft 2 at right angles thereto and communicates at the one end with the shaft and at the other end with an inclined nozzle 5 the other end of which is connected to and communicates with the housing 3 tangential thereto. The inclined nozzle 5 has an operation chamber 16 within which a needle valve 6 is provided to regulate the opening of the nozzle 5. The needle valve 6 is adjustably pivotally connected by means of a bolt 7 to one end of link 8 which is pivoted in an intermediate position to a pin 9 secured to the outer periphery of the rotary hollow shaft 2. An annular movable member 10 is mounted on the rotary hollow shaft 2 for slidable movement along the shaft in the axial direction of the latter and a connection rod 11 is pivotally connected at one end to the annular member 10 and has a centrifugal switch (not shown) secured to the other end of the connection rod. The centrifugal switch is adapted to operate in response to rotary centrifugal force so as to slidably move the annular member 10 along the rotary hollow shaft 2 in the axial direction of the latter through the connection rod 11. A spring 12 is anchored at one end to the outer periphery of the rotary hollow shaft 2 and at the other end to the link 8 so as to always urge the free end of the link 8 against one, in this case the right-hand, side of the annular member 10 (as seen in FIG. 1). Thus, when the centrifugal switch operates in response to rotary centrifugal force, the switch causes the annular member 10 to move in one or the other direction along the rotary hollow shaft 2 through the connection rod 11 a distance depending upon the magnitude of the rotary centrifugal force. Such movement of the annular member 10 along the shaft 2 in turn advances or retracts the needle valve 6 within the operation chamber 16 defined in the nozzle 5 to thereby regulate the opening of the nozzle 5 resulting in the maintenance of a constant rotation output.

First, second and third tubines 13, 14 and 15 are disposed one after another (as seen from the left-hand side towards the right-hand side of the housing) within the turbine housing 3 in the axial direction of the housing and mounted on their respectively associated coaxial drive shafts 13*a*, 14*a* and 15*a*, respectively, which have different diameters and lengths. The first turbine drive shaft 13*a* has the longest length and the smallest diameter and extends from a position slightly spaced from the inner surface of the left-hand side wall of the housing 3 through the right-hand side wall of the housing to an external position outside of the housing. The second turbine drive shaft 14*a* having an intermediate length and diameter is coaxially disposed about the first turbine drive shaft 13*a* and extends from a position short of the left-hand end of the shaft 13*a* through the right-hand side wall of the housing 3 to an external position short of the right-hand end of the first turbine drive shaft 13*a*. The third turbine drive shaft 15*a* having the shortest length and largest diameter is disposed about the second turbine drive shaft 14*a* in coaxial relationship to the first and second turbine drive shafts 13*a* and 14*a* and extends from a position short of the left-hand end of the second turbine drive shaft 14*a* through the right-hand side wall of the housing 3 to an external position short of the right-hand end of the second turbine drive shaft 14*a*. The blades of the first turbine 13 have a substantially V-shaped cross section as seen in side elevation, the blades of the second turbine 14 have a substantially inverted V-shaped cross section as seen in side elevation. The blades of the third turbine 15 have the same cross section as that of the blades of the first turbine 13. Thus, in operation, the rotary shaft 2 and housing assembly 3 and second turbine 14 rotate in one direction and the first and third turbines 13 and 15 in the other or opposite direction.

A transmission means is connected between the turbine shafts, an output shaft 18 parallel to the turbine housing axis, and the turbine housing itself. The transmission means is constituted by a first larger gear 17 mounted around the housing 3 and meshing with a first pinion 19 mounted on the output shaft 18 which extends parallel to the axis of the housing 3. A larger gear 20 having the same diameter as the first larger gear 17 is also mounted on the output shaft 18 outside of the housing 3 and meshes with a pinion 21 mounted on the second turbine drive shaft 14*a* outside of the housing 3 and having the same diameter as the pinion 19 on the output shaft 18. Reference numeral 22 denotes a first smaller diameter sprocket wheel mounted on the first turbine drive shaft 13*a* outside of the housing 3 and reference numeral 23 denotes a larger diameter second sprocket wheel 23 mounted on the output shaft 18 outside of the housing 3. An endless chain 24 is trained about the first and second sprocket wheels 22 and 23. Furthermore, a third smaller diameter sprocket wheel 25 is mounted on the third turbine drive shaft 15*a* outside of the housing 3 and a fourth larger diameter sprocket wheels 26 is mounted on the output shaft 18 in alignment with the third sprocket wheel 25 between the chain drive gear 23 and the first pinion 19. A second endless chain 27 is trained about the sprocket wheel 25 and 26.

As described hereinabove, since the turbine housing 3 and the second turbine drive shaft 14*a* rotate in the same direction, the housing 3 and the drive shaft 14*a* are interlocked with each other by the gears 20 and 21. And since the first and third turbine drive shafts 13*a* and 15*a* rotate in a direction opposite to the direction of rotation the housing 3 and second turbine drive shaft 14*a*, the first turbine shaft 13*a* and output shaft rotate in the same direction through the sprocket wheel and chain unit 22, 23, 24 the third turbine drive shaft 15*a* and the output shaft 18 rotate in the same direction through the sprocket wheel and chain unit 25, 26, 27 whereby the output shaft can provide a high output. The output shaft 18 is operatively connected through any suitable conventional transmission gearing (not shown) to a generator or the like (not shown). Reference numeral 30 denotes a fluid discharge port formed in the turbine housing 3 for discharging the exhaust fluid from the housing.

With the above-described construction and arrangement of the components of the engine according to the present invention, in operation, when exhaust fluid from a jet engine, steam engine or the like is fed by the fluid feed conduit 1 to the engine of the invention, the exhaust fluid is passed through the hollow rotary shaft 2, short fluid conduit 4 and nozzle 5 and jetted into the turbine housing 3 to act on the various turbines within the housing. Upon being acted on by the jetted exhaust fluid, the turbines at the different stages rotate independently of each other. As described hereinabove, since the blades of the first turbine have a substantially inverted V-shaped cross section, the blades of the second turbine have a substantially V-shaped cross section and the blades of the third turbine have the same cross section as that of the blades of the first turbine, the blades of each preceding turbine effectively guide the exhaust fluid onto the blades of the following turbine without fluid loss. Thus, the engine of the invention is not provided with any non-rotary guide spring which was necessary in the prior art engines of this type to which the present invention is directed. In all of the prior art speed governors of this type, when the jetted exhaust fluid strikes against the non-rotary guide spring, force loss has occurred. By the elimination of such a non-rotary guide, the present invention can effectively eliminate the disadvantage of force loss. Furthermore, according to the present invention, the space between the adjacent blades is designed to be rather wide for the flow rate of the exhaust fluid passing through the space between the blades so that the fluid can be effectively prevented from contacting the backs of the blades. With this arrangement, when subjected to impact by the exhaust fluid, the second and third turbines 14 and 15 rotate in opposite directions to each other and when the exhaust fluid jetted through the nozzle strikes against the first turbine 13 to rotate the first turbine 13, the housing 3 integral with the rotary hollow shaft 2 also rotates in the opposite direction to the direction of rotation the first turbine 13 in response to the reaction generated when the first turbine is struck by the fluid. However, since the first larger gear 17 mounted on the periphery of the housing 3 and the pinion 19 on the output shaft 18 mesh with each other, the rotational speed of the housing 3 is regulated with respect to the rotational speed of the turbine drive shafts operatively connected to the housing 3. However, since the rotation of the housing 3 is also transmitted to the output shaft 18, the output shaft provides a high constant output. The rotational speed of the output shaft 18 can be regulated by the opening and closing of the nozzle 5 which communicates with the turbine housing 3. The opening and closing of the nozzle 5 is effected by the needle valve 6 in the nozzle 5 and the needle valve also regulates the output of the output shaft 18 by regulating the opening of the nozzle 5 depending upon the position of the movable annular member 10 on the rotary hollow shaft 2. In this way, the engine of the invention directly responds to variation in load to be applied to the engine and thus, the output of the output shaft can be effectively utilized for its intended purpose without fluid loss.

The engine of the invention can be equally applied to engines for ships in addition to jet engines, steam engines or the like.

Although only one nozzle is provided in the illustrated embodiment of the engine of the invention, a plurality of nozzles can be employed within the scope of the invention.

While one particular embodiment of the invention has been shown in the drawing and described hereinabove, it will be apparent to those skilled in the art that many changes may be made in the form, arrangement and positioning of the various elements of the engine. In consideration thereof it should be understood that the preferred embodiment disclosed herein is intended to be illustrative only and not intended to limit the scope of the invention.

What is claimed is:

1. A fluid driven engine comprising:

a rotary hollow cylindrical shaft adapted to be rotatably mounted on a stationary fluid feed conduit for rotation around the axis of the stationary feed conduit;

a turbine housing coaxially secured to said rotary hollow cylindrical shaft for rotation with said cylindrical shaft and having at least one turbine rotatably mounted therein;

nozzle means in said housing connected between said cylindrical shaft and said turbine housing for directing fluid from said cylindrical shaft under pressure against said turbine for rotating said turbine, the reaction to the impact of the fluid on said turbine causing said housing to rotate;

a turbine shaft driven by said turbine;

an engine output shaft; and transmission means connected between said turbine shaft, said housing and said engine output shaft and transmitting the rotation of said turbine and said turbine housing to said engine output shaft and limiting the speed of rotation of said turbine housing to a speed slower than the rotational speed of said turbine.

2. An engine as claimed in claim 1 further comprising an annular member movably mounted on said rotary hollow cylindrical shaft for movement in the axial direction of said cylindrical shaft, a connector rod having one end connected to said annular member, and the other end of which is adapted to be connected to drive regulating means, said nozzle being a variable opening nozzle, and connecting means connected to said nozzle for regulating the opening of said nozzle and being engaged by said annular member for being moved in response to movement of said annular member.

3. An engine as claimed in claim 2 in which said connecting means is a link pivoted to said rotary hollow shaft and having one end connected to said needle valve and a spring connected between said rotary hollow shaft and link for normally urging the other end of said link against said annular member.

4. An engine as claimed in claim 1 in which said turbine is a first turbine, and said housing further has second and third turbines in side-by-side relationship therein and coaxial with said first turbine, second and third turbine shafts supporting said second and third turbines, respectively, the blades on said second and third turbines being shaped for driving said second turbine in the opposite rotational direction from said first turbine and driving said third turbine in the same rotational direction, said transmission means further connecting said second and third turbine shafts to said engine output shaft.

5. The engine as claimed in claim 8 in which said first turbine shaft has the greatest length and the smallest diameter, said second turbine shaft has an intermediate length and diameter and is hollow and coaxial around said first turbine shaft, and said third turbine shaft has the shortest length and largest diameter and is hollow and coaxial around said second turbine shaft.

6. The engine as claimed in claim 5 in which said first, second and third turbine shafts extend from different positions within said housing through the side wall thereof opposite the rotary hollow cylindrical shaft to different positions outside said turbine housing.

7. The engine as claimed in claim 6 in which said engine output shaft is parallel to said turbine shaft and in which said transmission means includes a first larger gear mounted on the outer periphery of said housing, a first pinion mounted on said engine output shaft and meshing with said first larger gear, a second larger gear mounted on said engine output shaft, a second pinion mounted on said secondary turbine shaft and meshing with said first larger gear, a first sprocket wheel mounted on said first turbine shaft, a second sprocket wheel mounted on said engine output shaft in alignment with said first sprocket wheel, a first chain trained about said first and second sprocket wheels, a third sprocket wheel mounted on said third turbine shaft, a fourth sprocket wheel mounted on said engine output shaft in alignment with said third sprocket wheel, and a second chain trained about said third and fourth sprocket wheels.

* * * * *